United States Patent [19]

Share et al.

[11] Patent Number: 4,784,221

[45] Date of Patent: Nov. 15, 1988

[54] WELLPOINT SYSTEM AND REEL

[76] Inventors: Jack H. Share, P.O. Box 67, Port Orange, Fla. 32019; Stanley Share, 211 Ellicott Dr., Ormond Beach, Fla. 32074

[21] Appl. No.: 54,795

[22] Filed: May 27, 1987

[51] Int. Cl.[4] ..... E21B 43/00; E02B 11/00

[52] U.S. Cl. ..... 166/52; 242/86.2; 242/86.4; 405/51

[58] Field of Search ..... 166/52, 75 R, 207, 378, 166/379, 380; 137/355.26; 405/36, 51; 242/94, 86.2, 86.3, 86.4, 86.7

[56] References Cited

U.S. PATENT DOCUMENTS

| | | | |
|---|---|---|---|
| 218,875 | 8/1879 | Green | 166/52 |
| 308,411 | 11/1884 | Harding et al. | 242/86.3 |
| 2,549,224 | 4/1951 | Moldovan | 242/86.4 X |
| 2,755,035 | 7/1956 | Moulder | 242/86.2 |
| 3,207,456 | 9/1965 | Hill | 242/86.4 X |
| 3,566,982 | 3/1971 | Share et al. | 166/52 X |

*Primary Examiner*—Hoang C. Dang

*Attorney, Agent, or Firm*—William M. Hobby, III

[57] ABSTRACT

A well point assembly is provided having an elongated flexible header pipe with a plurality of coupling joints attached thereto for attaching wellpoint assemblies. A flexible header pipe reel stores the flexible header pipe when not in use and allows the header pipe to be reeled off and positioned around an excavation site. A flexible wellpoint header pipe distribution reel is provided having a wheeled transport having at least two wheels. An axle has two wheels attached thereto and each wheel is rotably separate from the other wheel. The flexible wellpoint header pipe reel is mounted to the axle and rotable relative to the wheels. Reel handles are attached to the reel for rotating the reel relative to the wheel and flexible wellpoint header pipe is wrapped around the reel and is adapted to be reeled off responsive to rotation of the reel. The wellpoint header reel includes a lock for locking the reel and at least one wheel together, and the ratchet and pawl mechanism, which can be shifted to allow the reel to rotate in either direction relative to the wheels or can be shifted to allow the reel to rotate in either one or the other direction relative to the wheels.

8 Claims, 3 Drawing Sheets

WELLPOINT SYSTEM AND REEL

This application is a continuation-in-part of our prior patent application Ser. No. 592,534, filed Mar. 26, 1984, for WellPoint Assembly and Method of Installing a Wellpoint Assembly.

BACKGROUND OF THE INVENTION

The present invention relates to a flexible wellpoint header pipe distribution apparatus, and especially to a wheeled reel for holding flexible wellpoint header pipe for rapid installation of the pipe in a wellpoint system.

It is necessary to dewater a construction area when construction work is being done below the ground surface in order to remove all water and other liquids from an excavation area to provide dry working conditions. The most common technique of dewatering an excavation area is to sink a plurality of wellpoints around the area and connect a pump to each of the well points so that the water will be pumped from the area surrounding the excavation. In a typical wellpoint system, a series of rigid header pipe, such as PVC plastic pipe, is laid around the excavation site and the pipes installed together through clamp-type pipe couplings. The rigid header pipe has holes drilled therein and a coupling attached to the holes in the header pipe so that a wellpoint assembly can be attached to the rigid header pipe. The wellpoint assembly may include a short smaller pipe having a coupling thereto for coupling to the rigid header pipe and to the top of one of the wellpoint well heads. The entire wellpoint system is attached to a dewatering pump to remove water from each of the wellpoint assemblies into the rigid header pipe to maintain the excavation area dry. This type of wellpoint system has worked satisfactory for many years but requires the use of large amounts of rigid pipe which typically may be 20 feet long and various types of coupling mechanisms for coupling the pipe together. When using a typical rigid header pipe system that is to conform with the shape of the excavated area, it is necessary to use various fittings, ells, tees, couplings, clamps and multiple lengths of pipe to custom assemble the header line. Each well point installation is essentially a ring system and the cost of installing and removing the rigid pipe is further complicated by the removal of the system which frequently has little salvage value, except for the pump, for any other well point installation.

There have been any number of prior wellpoint systems but one system can be seen in our prior U.S. Pat. No. 3,566,982 dated Mar. 2, 1971 for a wellpoint system. Another typical system can be seen in U.S. Pat. No. 4,020,902 and in U.S. Pat. No. 3,995,690 for wellpoint systems and in the various references cited in these patents. The aim of the present invention is to overcome the difficulties in setting up, removing and resetting up a wellpoint system by providing a flexible wellpoint header having attached couplings for wellpoint assemblies and means for storing the pipe on a reel and for aligning the pipe for the attachment of the wellpoint assemblies.

Specifically, the present invention involves the distribution and transport of flexible wellpoint header pipe, which has a reel rotably supported between two wheels and which can be locked to one of the wheels for rotation therewith or can be allowed to free-wheel between the wheels or alternatively can be made to rotate in only one or the other direction as desired.

The present invention deals with a flexible header pipe which is formed of one continuous piece in any length desired and has couplings already formed therein at spaced points along the flexible header pipe for attaching well point assemblies. The flexible header pipe can be stored and removed from a large reel and shaped to form a wellpoint layout of any desired pattern for attaching the wellpoint assembles. This is especially productive in progressive wellpointing for long utility sewer and force main lines where 50 feet to 100 feet of flexible header can be moved on the ground by hand or mechanical means to its next location without being disassembled and loaded onto a vehicle and then reassembled again for installation.

Prior U.S. patents which utilize various types of reel systems include the Moldovan U.S. Pat. No. 2,549,224, which is for a garden hose reel which has the inner reel supporting a hose riding on outer wheels and which allows the hose to be unreeled from the inner reel. The Shaw & Ashley U.S. Pat. No. 127,277 shows a hose cart with outer wheels and with an inner reel mounted thereon. The B. E. Schjerven patent, U.S. Pat. No. 3,152,772 illustrates a transporting device for hoses having a cable drum riding on outer wheels, while the Hill patent, U.S. Pat. No. 3,207,456 illustrates a cable or rope drum or reel concentrically mounted on the axle of a pair of wheels for separate rotation thereon. The Fortson patent, U.S. Pat. No. 3,680,807 illustrates another reel patent. None of these prior art patents deal with flexible wellpoint header distribution systems as illustrated in my prior U.S. patent application, Ser. No. 592,534, filed Mar. 26, 1984, for a Wellpoint Assembly and Method of Installing a Wellpoint Assembly.

SUMMARY OF THE INVENTION

A wellpoint assembly includes an elongated flexible header pipe which has a plurality of coupling joints formed therein for attaching well point assemblies. The flexible header pipe is stored on a reel so that it can be unreeled into a predetermined pattern for installing in a wellpoint system.

The present invention relates a wellpoint header reel and especially to a flexible wellpoint header pipe distribution apparatus which includes a wheeled transport having at least two wheels, an axle having the two wheels supported thereon and each wheel being rotably separate from the other wheel. A flexible wellpoint header pipe reel is mounted to the axle and rotates relative to the wheels, but may be locked to rotate with the wheels. Reel handles are attached to the reel for use in rotating the reel relative to the wheels, and a flexible wellpoint header pipe is wrapped around the reel and adapted to be reeled off responsive to rotation of the reel. The axle may be formed as part of the header pipe reel with the wheels having hub sleeves for rotation on each end of the axle. A wheel lock may be a spring-loaded pin sliding in a sleeve perpendicular to the wheel hub sleeve for sliding into a bore in the axle. The pin may be spring-loaded and having a handle which can be latched in an unlocked position. A ratchet and pawl mechanism may have a ratchet gear with angled sprocket teeth attached to the reel and a pawl mechanism attached to one wheel reel and shifted between three positions to allow the reel to rotate relative to the wheel in both directions or in one or the other direction, depending upon which of two spring-loaded pawl arms is released upon the ratchet sprocket. Thus the wheeled reel can be rolled with the reel and header pipe and the reel released to start releasing the header pipe as the wheels are rolled and the wheels can be rolled independently of each other to move in intricate patterns for laying out a wellpoint system.

A method of installing a wellpoint system includes the steps of unreeling a flexible header pipe from a reel by rolling the wheeled reel to a desired location and rolling the wheels to unreel the reeled flexible header pipe, laying the flexible header pipe being unreeled in a pattern around an excavation site for installing a wellpoint system, aligning the flexible header pipe for attaching wellpoint assemblies, removing the coupling plugs from the wellpoint coupling members in the flexible header pipe, and attaching the wellpoint assembly connecting lines. The wheeled reel may also have its wheels locked and the flexible header pipe pulled off the reel. The flexible header pipe will of course have to be connected to a dewatering pump and the wellpoints will have to be placed in the earth around the excavation connected to a swing joint which which connects to the flexible header pipe.

BRIEF DESCRIPTION OF THE DRAWINGS

Other objects, features and advantages of the present invention will be apparent from the written description and the drawings in which.

DESCRIPTION OF THE PREFERRED EMBODIMENTS

Figure 1:
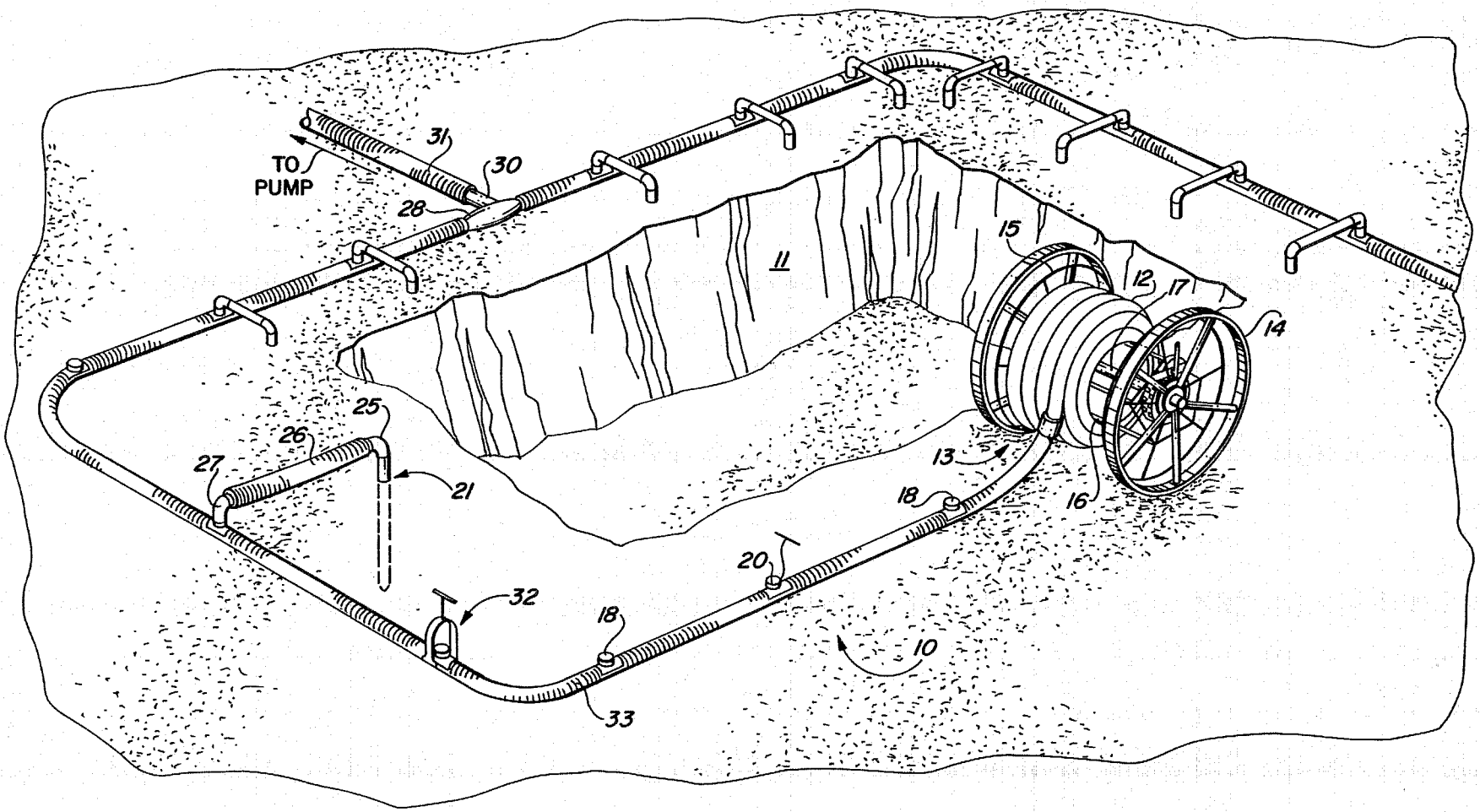
FIG. 1 shows a perspective view of a wellpoint assembly positioned around an excavation site.

Referring to the drawings, and especially to FIG. 1, a well point system 10 is placed around an excavation site 11 and includes a flexible header pipe 12 which may be a transparent polymer pipe which is being unrolled from a large reel 13. The reel 13 has wheels 14 with handles 15 with a reel portion 16 having an axle 17 and a portion of the flexible header pipe 12 wrapped around the reel portion 16. The flexible header pipe 12 has a plurality of saddle joints or couplings 18 having removal saddle plugs 20 therein. The flexible header pipe 12 extends around the excavation site 11 and has a plurality of well point assemblies 21 attached thereto. The well point assemblies include a wellpoint, a riser pipe, and a well head (as indicated by the dashed lines) connected into an elbow connector 25 which is connected to a short flexible swing line or pipe 26 which in turn is connected to an elbow coupling 27 which connects pipe 26 to the flexible header pipe 12. Having the flexible header pipe 12 allows the entire wellpoint system of FIG. 1 to be laid out with one continuous length of pipe having any number of well point assemblies 21 attached thereto. It also allows any particular wellpoint assembly coupling 18 to remain unused and plugged with a saddle plug 20. If the excavation site 11 is too large for the flexible header pipe 12 which can be made of any length desired, the length may be extended by the use of a T-joint 28 to add an additional flexible header pipe to the existing pipe and at the same time provide an additional coupling 30 for additional wellpoint assembly 31. The coupling joints 18 may be aligned for the attachment of the elbows 27 in that the flexible continuous length header couplings may end up positioned in a great variety of positions. This is solved by the flexible header aligning tool 32 which is pushed into the earth over the flexible header pipe adjacent a saddle joint 18 to lock the saddle joint with its center axis extending vertically for the attachment of the elbow 27. Header alignment tool 32 may be attached in a plurality of positions especially around the sharp curve 33 in the layout pattern for the wellpoint system so that all of the joints 18 are aligned in the proper position for attaching the elbow connectors 27 for connecting the well point assemblies 21. Once the wellpoint assembly is connected, the header alignment tools 32 can be removed if desired since the flexible header pipe 12 will be held in position by the couplings to the wellpoint assemblies.

Referring to FIGS. 2 through 7 of the drawings, a wellpoint header reel is illustrated having a first wheel 35 and a second wheel 36, each having spokes 37 connecting to a central hub sleeve 38. The hub 38 has a flange 40 for the radial spokes 37 to be attached to. A reel illustrated generally as 16 includes an axle 17 having a plurality of radially extending reel frame members 42 connected to reel pipe support members 43 which are in turn inner-connected by bracing frame members 44. A flexible wellpoint header pipe 12 is wrapped on the reel 16 and has a pipe end 45. The axle 17 forms part of the reel 16 and rotates with the reel.

In operation, the wheels 35 and 36 can be rolled by hand to a starting position for the flexible header pipe 12. The pipe end 45 can be held and the wheels 35 and 36 rolled to allow the reel 16 to rotate independently as the wheels 35 and 36 are pulled along, or alternatively, the wheels 35 and 36 can be rolled to a position desired, the end of the header pipe 45 grabbed and pulled off the reel with the wheels 35 and 36 held stationary. A ratchet and pawl mechanism 46 is designed to allow the reel 16 to rotate in either direction relative to the wheel 36, or alternative, to latch the reel so that it can rotate in either a counter-clockwise direction only, or in a clockwise direction only, depending on whether the header pipe 12 is being reeled onto the reel 16 or being unreeled from the reel 16.

Figure 3:
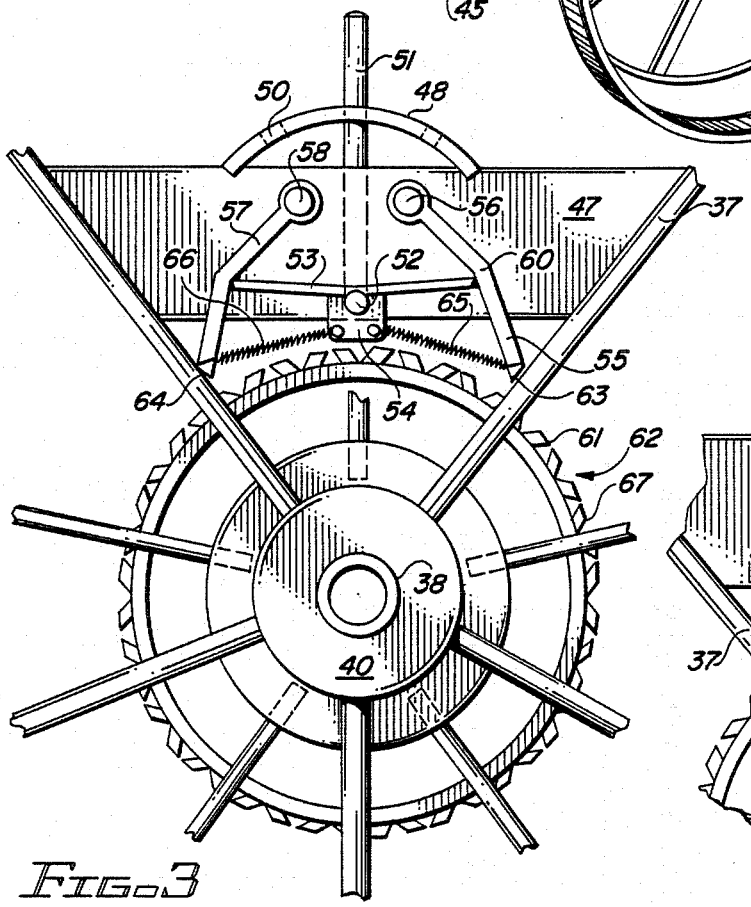
FIG. 3 is a partial side elevation of the ratchet mechanism and wheel of FIG. 2.
Figure 4:
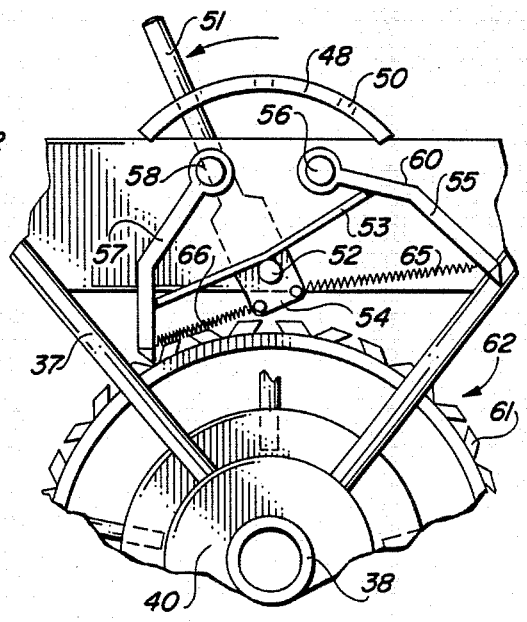
FIG. 4 is a partial side elevation of the ratchet mechanism of FIG. 3, latching the reel for rotation in only one direction.
Figure 5:
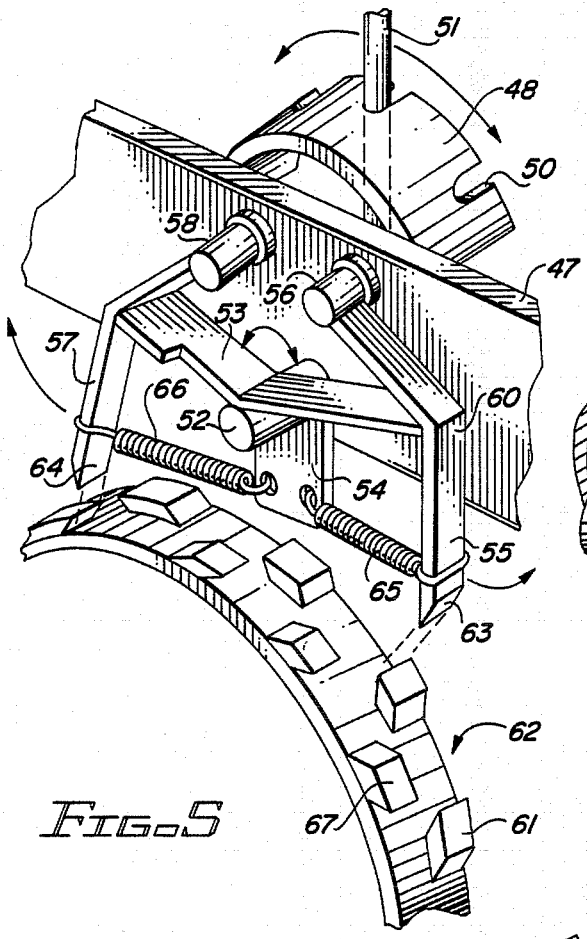
FIG. 5 is a partial perspective view of the ratchet mechanism of FIGS. 2 through 4.

FIGS. 3, 4 and 5 more clearly illustrate the operation of the ratchet and pawl mechanism. A cross support member 47 is connected between two spokes 37 of the wheel 36 and has an arcuate locking member 48 having three slots 50 therein. A control handle 51 is pinned at 52 with arm 53 extending out in each direction and a plate 54 extending therebeneath. A first ratchet arm 55 is pinned at 56 and a second ratchet arm 57 is pinned at 58 and each has an elbow portion 60 therein. Cross arm 53 extends into the elbows 60 of the arms 55 and 57 extending them away from the teeth 61 of the ratchet gear 62. Arm 55 has a pointed end 63, while arm 57 has a pointed end 64. Arm 55 has a spring 65 connected thereto and to the plate 54, while arm 57 has a spring 66 connected thereto and connected to the plate 54. With the handle 51 in the center slot 50, the arm 53 pushes both arms 55 and 57 out of contact with the ratchet 62. Rotating the arm 51 and sliding it into either of the other slots 50 will push one arm 55 or 57 further out of contact with the gear 62 and allow the spring 65 or 66 to pull the one arm into contact with the ratchet gear 62 as shown in FIG. 4. The gear teeth 61 are formed with angled surfaces 67 angled in opposite direction so that either the point 64 of the arm 57 or the point 63 of the arm 55 can engage a tooth 61. Thus the springloaded arms 60 and 57 will have one or the other pulled against a ratchet gear 62, but because of the angled surfaces 67 of the teeth 61, the ratchet gear 62 can rotate in one direction but is blocked by either the arm 60 or 57 from rotating in the opposite direction. When the handle 51 is in the center slot, however, both arms 60 and 57 are maintained outside of contact with the ratchet wheel 62 and the reel 16 can rotate in either direction.

Figure 2:
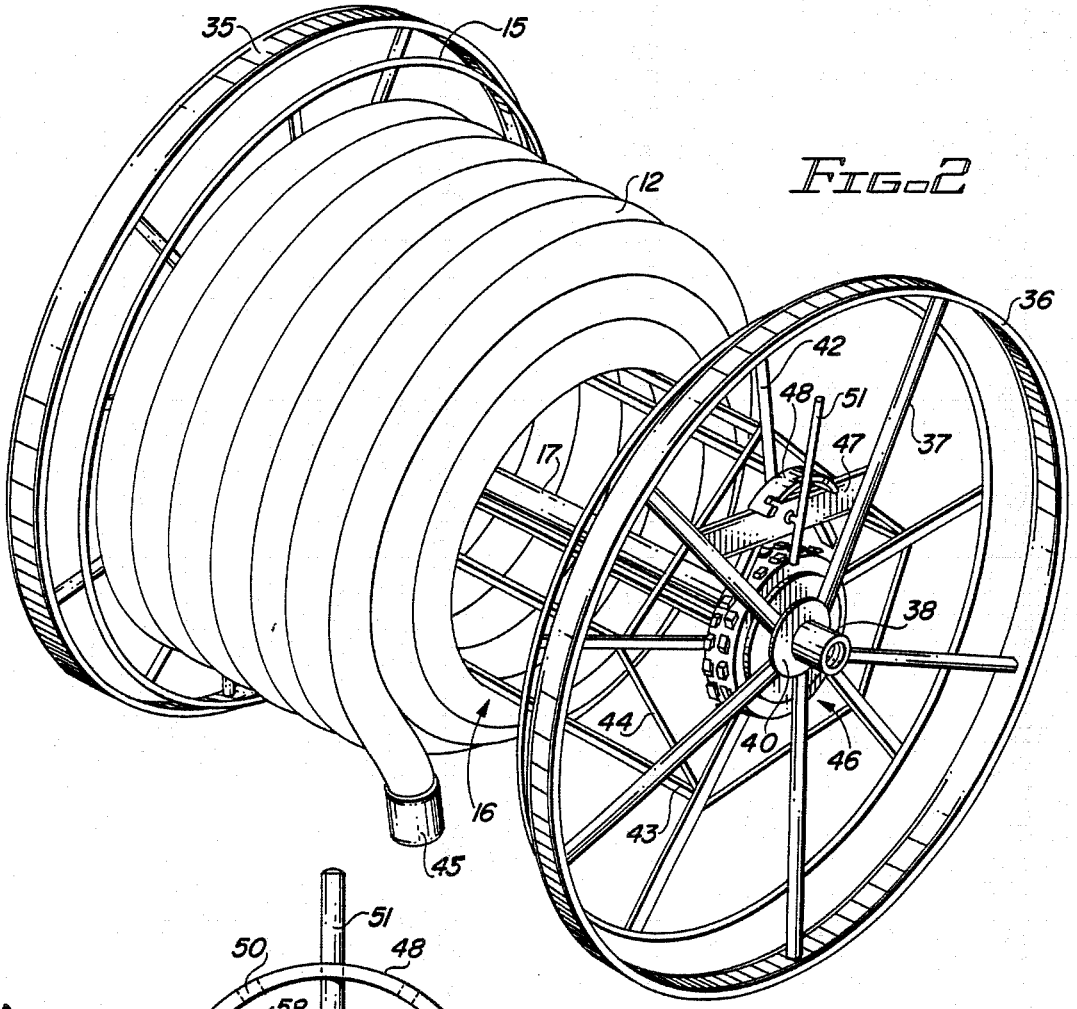
FIG. 2 is a perspective view of a wellpoint header reel in accordance with my invention.
Figure 7:
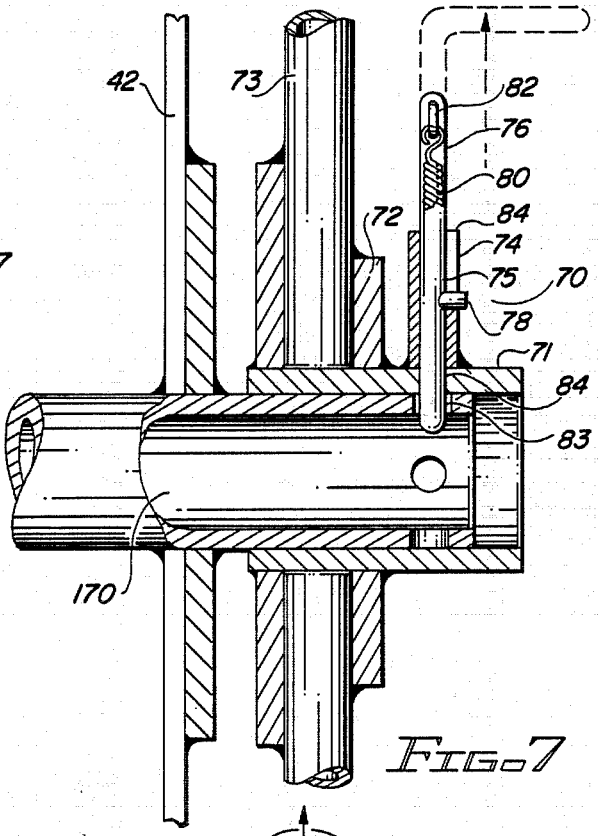
FIG. 7 is a partial sectional view taken on line 7—7 of FIG. 6.
Figure 6:
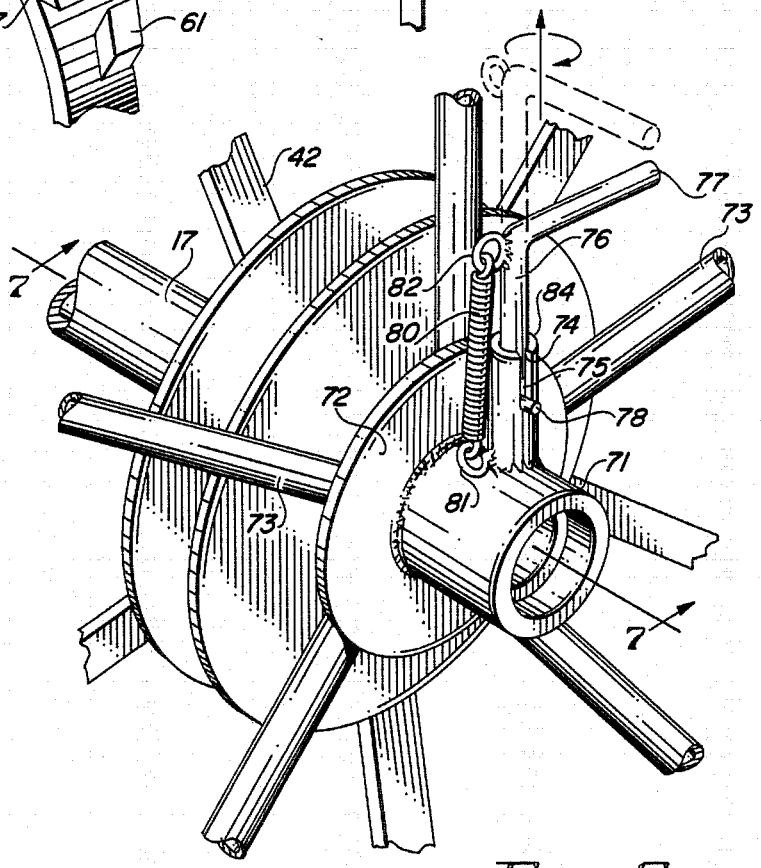
FIG. 6 is a partial perspective view of the wheel lock in accordance with the present invention.

Referring to FIGS. 6 and 7, a locking mechanism 70 is illustrated as attached to the hub sleeve 71 of the wheel 35. The hub sleeve 71 has the hub flange 72 connected to the radially extending spokes 73 and has the axle 17 extending into the sleeve 71 and attached to reel frame members 42. The reel frame members also extend pass the reel support members 43, as shown in FIG. 2, to support circular handles 15 adjacent each of the wheels 35 and 36 for rotating the reel 16 with the handles 15 while holding the wheels 35 and 36.

The locking mechanism includes a sleeve 74 extending perpendicular from the hub sleeve 71 and having an elongated slot 75 extending thereinto. A locking arm 76 has a handle 77 on one end and a locking pin 78 attached between its ends. A spring 80 is attached to an eyelet 81 attached to the sleeve 71 at one end, and the other end of the spring 80 is attached to an eyelet 82 attached to the locking pin 76 to spring load the locking pin 76 towards the sleeve 71 and the axle 17. The axle 17 extending into the hub 71 has a transverse bore 83 therethrough in direct alignment with the openings 84 and the locking arm 76. When the arm 78 is in the slot 75, the spring 80 biases the locking arm 76 against the axle 17 until the bore 83 comes into alignment, at which time the arm 76 slides into the bore 83 as shown in FIG. 7, locking the axle 17 to the wheel 35 which locks the reel 16 to the wheel 35 so that they can only be rotated together. The lock arm 76 can be disengaged by grasping the handle 77 and pulling the arm 76 in the sleeve 74 until the pin 78 extends outside the slot 75 and then rotating the handle so that the pin 78 is supported on the ledge 84 of the perpendicular sleeve 74.

In operation, the reel 16 can be locked to the wheel 35 with the wheel lock 70, or alternatively, can be released to free-wheel relative to the wheel 35. In contrast, the ratchet and pawl mechanism 46 allows the reel 16 to free-wheel on the wheel 36, hub 38 or to rotate in either a clockwise direction or a counterclockwise direction only, depending upon which slot of the arcuate bracket 48 that the handle 51 is positioned in. The flexible wellpoint header pipe and reel 13 can be transported in a truck to a construction site, rolled off the truck to the place to start positioning the wellpoint header, at which point the wellpoint header can be reeled off the reel 16 while holding the wheels 35 and 36 and unlocking the lock 70, or the wheels 35 and 36 can be rotated while pulling the flexible header 12 from the reel 16. This allows the rapid placement of the flexible header pipe 12 around the construction site. The wheeled reel 13 can be easily positioned since the wheels 35 and 36 rotate separately, and one can be held while the other one is rotated to give a very sharp turn in the wellpoint systems pattern.

The present invention, however, also contemplates the method of installing a wellpoint system in accordance with the apparatus illustrated and includes the steps of reeling the flexible header pipe 12 onto a large custom reel 13 for transporting to an excavation site 11, rolling the reel 13 on wheels 35 and 36 to the desired position, unreeling the flexible header pipe 12 from the reel 13 by unrolling the reel 16 while rolling the wheels 35 and 36 on locking the wheels and unreeling the header pipe 12, then laying the flexible header pipe in a pattern such as shown in FIG. 1. The flexible header pipe may be transparent for observing the flow of fluid and for locating air bubbles or leaks to keep the system flowing smoothly. Once the flexible header pipe 12 is aligned around an excavation site, the coupling joints in the header pipe 12 are aligned with the header alignment tool 32 to position the couplings 18 in a predetermined position for receiving coupling elbows 27 for the well point assemblies. The well point assembly couplings not being used may have saddle plugs 20 placed in those couplings 18 not being connected to a wellpoint assembly 21.

It should be clear at this point that a wellpoint header reel has been provided which can be easily utilized in connection with a flexible wellpoint header system. However, the present invention is not to be considered limited to the forms shown which are to be considered illustrative rather than restrictive.

We claim:

1. A flexible wellpoint header pipe distribution apparatus comprising:

a wheel transport having at least two wheels;

an axle having each said wheel rotatable separately thereon;

a flexible wellpoint header pipe reel mounted to said axle and rotatable relative to said wheels;

reel handles attached to said reel for rotating said reel relative to said wheels;

flexible wellpoint header pipe wrapped around said reel and adapted to be reeled off responsive to rotation of said flexible wellpoint header pipe reel by rotation of said reel;

an annular ratchet being attached to said flexible wellpoint header reel and a pair of pawls being attached to one said wheel; and means to engage one of said pawls with said annular ratchet to thereby allow said reel to rotate in only one direction relative to said wheels when one said pawl engages said annular ratchet.

2. A flexible wellpoint header pipe distribution apparatus in accordance with claim 1 in which said axle forms a part of said flexible wellpoint header pipe reel and each of said wheels rotates on said axle.

3. A flexible wellpoint header pipe distribution apparatus in accordance with claim 2 in which said reel handles includes an arcuate reel handle on either side of said reel.

4. A flexible wellpoint header pipe distribution apparatus in accordance with claim 3 including a wheel locking mechanism attached to one of said wheels, locking said axle to said wheel for locking said flexible wellpoint header pipe reel to said one wheel.

5. A flexible wellpoint header pipe distribution apparatus in accordance with claim 4 in which each said wheel has a hub sleeve having a plurality of spokes attached thereto, and one said wheel hub has a perpendicular sleeve with a slot therein attached thereto having a spring loaded pin extending therethrough, said pin having a perpendicular arm extending therefrom and riding in said perpendicular sleeve slot and said axle has at least one bore extending thereinto for receiving said locking pin.

6. A flexible wellpoint header pipe distribution apparatus in accordance with claim 1, in which said means to engage one of said pawls includes a movable camming plate positioned between said pawls and rotatable to cam one pawl into said ratchet while moving the other pawl out of contact with said ratchet and positionable to push both pawls out of contact with said ratchet.

7. A flexible wellpoint header pipe distribution apparatus in accordance with claim 6 in which each said pawl is spring loaded to said camming plate and has an angled camming surface formed therein.

8. A flexible wellpoint header pipe distribution apparatus in accordance with claim 7, in which a camming plate handle is attached to said camming plate and shifts said pawls responsive to moving said camming plate handle between slots in a locking member, said locking member slots being positioned to engage one pawl against said ratchet or to disengage both pawls.

* * * * *